US005610354A

United States Patent [19]

Masahiro et al.

[11] Patent Number: 5,610,354

[45] Date of Patent: Mar. 11, 1997

[54] MUSICAL TONE SIGNAL SYNTHESIZER

[75] Inventors: Koyama Masahiro; Nishimoto Tetsuo, both of Hamamatsu, Japan

[73] Assignee: Yamaha Corporation, Japan

[21] Appl. No.: 587,835

[22] Filed: Jan. 11, 1996

[30] Foreign Application Priority Data

Jan. 12, 1995 [JP] Japan ..... 7-003616

[51] Int. Cl.[6] ..... G10H 1/06; G10H 7/00

[52] U.S. Cl. ..... 84/624; 84/622; 84/659

[58] Field of Search ..... 84/622–625, 659–660, 84/DIG. 9

[56] References Cited

U.S. PATENT DOCUMENTS

| | | | |
|---|---|---|---|
| 4,200,021 | 4/1980 | Chibana | 84/604 |
| 4,597,318 | 7/1986 | Nikaido et al. | 84/625 |
| 5,138,927 | 8/1992 | Nishimoto | 84/624 |

FOREIGN PATENT DOCUMENTS

| | | |
|---|---|---|
| 64-4199 | 1/1989 | Japan . |
| 2-254497 | 10/1990 | Japan . |

*Primary Examiner*—David S. Martin
*Assistant Examiner*—Marlon Torriano Fletcher
*Attorney, Agent, or Firm*—Graham & James LLP

[57] ABSTRACT

A musical tone signal synthesizer wherein a first waveform signal of a frequency defined by first frequency information is produced as a modulation signal, a second waveform signal indicative of a windowing function is produced at a cycle defined by second frequency information and a third waveform signal starting from a predetermined phase at each cycle of the second waveform signal is repeatedly produced at a shorter cycle than that of the second waveform signal, and wherein the second and third waveform signals are modulated by the first waveform signal and multiplied to produce a fourth waveform signal as a musical tone signal having a fixed formant characteristic comprised of a plurality of formants.

5 Claims, 14 Drawing Sheets

PHASE DATA PRODUCING CIRCUIT
44a
44b
PHASE DATA PRODUCING CIRCUIT
41a
41b
PHASE DATA PRODUCING CIRCUIT
52a
52b
STANDARD WAVEFORM PRODUCING CIRCUIT
46a
46b
WINDOWING FUNCTION WAVEFORM PRODUCING CIRCUIT
43a
43b
ENVELOPE WAVEFORM PRODUCING CIRCUIT
49
SELECTOR
54a
54b
COMPARATOR
53a
53b
SHIFTER
51
FC
FP
BW
KON
SY
WS
SKT
EGP
M1
M2
a1
a2
b1
b2
c1
c2
d1
d2
e1
e2
f
01
02
45a
45b
47a
47b
48
55
42a
42b

MUSICAL TONE SIGNAL SYNTHESIZER

BACKGROUND OF THE INVENTION

1. Field of the Invention

The present invention relates to a musical tone signal synthesizer of the modulation type, and more particularly to a musical tone signal synthesizer wherein a sideband wave caused by modulation is utilized to synthesize a musical tone signal of a fixed formant characteristic.

2. Description of the Prior Art

Disclosed in Japanese Patent Laid-open Publication No. 2(1990)-254497 is a musical tone signal synthesizer wherein a windowing function waveform signal is repeatedly produced at a cycle corresponding with a frequency of a musical tone signal to be generated or a frequency of integer times the frequency of the musical tone signal so that a waveform signal starting from a predetermined phase at each cycle of the windowing function waveform signal is repeatedly produced at a shorter cycle than that of the windowing function waveform signal, and wherein the produced waveform signals are multiplied to synthesize a musical tone signal of a fixed formant characteristic. Disclosed also in Japanese Patent Publication No. 64(1989)-4199 is a musical tone signal synthesizer of the frequency modulation type wherein a waveform signal is produced as a carrier at a frequency of a musical tone signal to be generated or a frequency of integer times the frequency of the musical tone signal, and wherein another waveform signal is produced as a modulation wave at a frequency related to integer times the frequency of the carrier so that frequency modulation of the carrier is effected by the modulation wave to obtain a plurality of sideband waves for synthesis of a musical tone signal.

In the case that the former musical tone signal synthesizer is adapted to synthesize a musical tone signal with a plurality of formants, it is required to provide a plurality of musical tone signal synthesizers in parallel in accordance with the number of formants. This means that the whole construction of the musical tone signal synthesizers becomes complicated. In the latter musical tone signal synthesizer, a distributed condition of the sideband waves obtained by the frequency modulation may not be estimated in a simple manner. It is, therefore, difficult to synthesize a musical tone signal of a desired formant characteristic.

SUMMARY OF THE INVENTION

Accordingly, a primary object of the present invention is to provide a musical tone signal synthesizer capable of synthesizing a musical tone signal of a desired formant characteristic in a simple manner.

In the present invention, the primary object is accomplished by providing a musical tone signal synthesizer which comprises first waveform signal producing means for producing a first waveform signal of a frequency defined by first frequency information applied thereto; second waveform signal producing means for producing a second waveform signal indicative of a windowing function at a cycle defined by second frequency information applied thereto; third waveform signal producing means arranged to be synchronously controlled by the second waveform producing means for repeatedly producing a third waveform signal starting from a predetermined phase at each cycle of the second waveform signal at a shorter cycle than that of the second waveform signal; modulation means for applying the first waveform signal as a modulation signal to the second waveform signal producing means for modulation of the second waveform signal; and means for multiplying the second and third waveform signals to produce a fourth waveform signal as a musical tone signal.

According to an aspect of the present invention, there is provided a musical tone signal synthesizer which comprises first waveform signal producing means for producing a first waveform signal of a frequency defined by first frequency information applied thereto; second waveform signal producing means for producing a second waveform signal indicative of a windowing function at a cycle defined by second frequency information applied thereto; third waveform signal producing means arranged to be synchronously controlled by the second waveform producing means for repeatedly producing a third waveform signal starting from a predetermined phase at each cycle of the second waveform signal at a shorter cycle than that of the second waveform signal; modulation means for applying the first waveform signal as a modulation signal to the third waveform signal producing means for modulation of the third waveform signal; and means for multiplying the second and third waveform signals to produce a fourth waveform signal as a musical tone signal.

According to another aspect of the present invention, there is provided a musical tone signal synthesizer which comprises first waveform signal producing means for producing a first waveform signal of a frequency defined by first frequency information applied thereto; second waveform signal producing means for producing a second waveform signal indicative of a windowing function at a cycle defined by second frequency information applied thereto; third waveform signal producing means arranged to be synchronously controlled by the second waveform producing means for repeatedly producing a third waveform signal starting from a predetermined phase at each cycle of the second waveform signal at a shorter cycle than that of the second waveform signal; first modulation means for applying the first waveform signal as a modulation signal to the second waveform signal producing means for modulation of the second waveform signal; and second modulation means for applying the first waveform signal as a modulation signal to the third waveform signal producing means for modulation of the third waveform signal; and means for multiplying the second and third waveform signals to produce a fourth waveform signal as a musical tone signal.

According to a still another aspect of the present invention, there is provided a musical tone signal synthesizer which comprises first waveform signal producing means for producing a first waveform signal of a frequency defined by first frequency information applied thereto; second waveform signal producing means for producing a second waveform signal indicative of a windowing function at a cycle defined by second frequency information applied thereto; third waveform signal producing means arranged to be synchronously controlled by the second waveform producing means for repeatedly producing a third waveform signal starting from a predetermined phase at each cycle of the second waveform signal at a shorter cycle than that of the second waveform signal; means for multiplying the second and third waveform signals to produce a fourth waveform signal as a musical tone signal; and modulation means for applying the fourth waveform signal as a modulation signal to the first waveform signal producing means for modulation of the first waveform signal.

In a practical application of the present invention, there is provided a musical tone signal synthesizer which comprises a first calculation unit including first waveform signal producing means for producing a first waveform signal of a frequency defined by first frequency information applied thereto and first modulation means for modulating the first waveform signal by a first modulation signal applied thereto; a second calculation unit including second waveform signal producing means for repeatedly producing a second waveform signal indicative of a windowing function at a cycle corresponding with a frequency defined by second frequency information applied thereto, third waveform signal producing means to be synchronously controlled by the second waveform signal producing means for repeatedly producing a third waveform signal starting from a predetermined phase at each cycle of the second waveform signal at a shorter cycle than that of the second waveform signal, means for multiplying the second and third waveform signals to produce a fourth waveform signal, and second modulation means for modulating the second and third waveform signals by a second modulation signal applied thereto; selective connection means for selectively connecting an output of the first calculation unit to a modulation input of the second modulation means in the second calculation unit and for selectively connecting an output of the second calculation unit to a modulation input of the first modulation means in the first calculation unit, wherein the output signal of the first or second calculation unit is output as a musical tone signal.

BRIEF DESCRIPTION OF THE DRAWINGS

Other objects, features and advantages of the present invention will be more readily appreciated from the following detailed description of a preferred embodiment thereof when taken together with the accompanying drawings, wherein the same reference numerals denote the same elements.

DESCRIPTION OF THE PREFERRED EMBODIMENT

Figure 1:
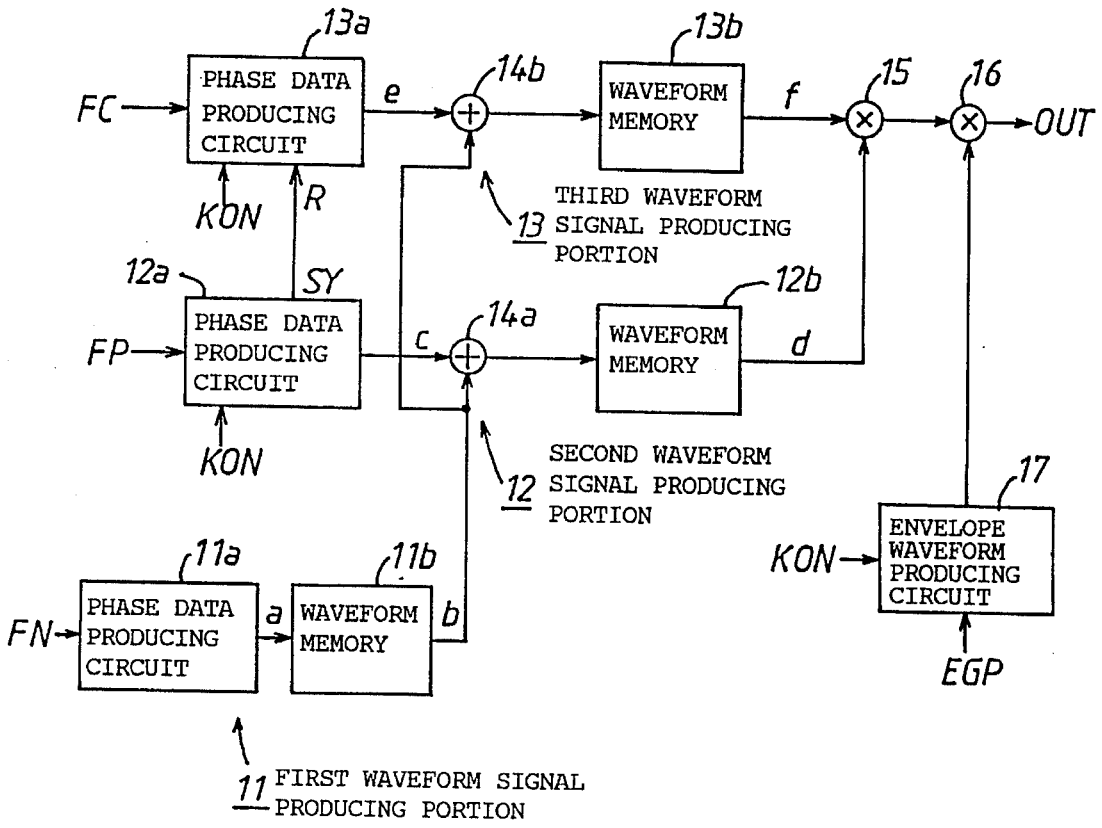
FIG. 1 is a block diagram of a first embodiment of a musical tone signal synthesizer in accordance with the present invention.

In FIG. 1 of the drawings, there is illustrated a block diagram of a first embodiment of a musical tone signal synthesizer in accordance with the present invention which includes first, second and third waveform signal producing portions 11, 12 and 13. The first waveform signal producing portion 11 is comprised of a phase data producing circuit 11*a* and a waveform memory 11*b*. The phase data producing circuit 11*a* includes an accumulator as a main component and is designed to accumulate frequency information data FN applied thereto at each timing defined by a clock signal (not shown) thereby to successively output the accumulated value as a phase data indicative of 0–2π. When the accumulated value becomes a predetermined value (for example, 2π), the phase data producing circuit 11*a* restarts to accumulate frequency information data applied thereto from an initial value (for example, 0). Thus, the production cycle of the phase data is defined by the applied frequency information data FN and becomes short in accordance with an increase of frequencies represented by the frequency information data FN, as shown by the character "a" in FIG. 2. The frequency information FN corresponds with a tone color designated by a tone color designation means such as a tone color selection device, an automatic performance apparatus or the like and represents a value proportional to a tone pitch frequency or integer times the tone pitch frequency (in an audible band) of a musical tone to be generated by a performance means such as a keyboard apparatus, the automatic performance apparatus or the like. The waveform memory 11*b* is arranged to memorize a number of sampling data indicative of a predetermined waveform (for instance, a sine wave) per one cycle. The sampling data are successively addressed by the phase data applied from the phase data producing circuit 11*a* so that the waveform signal indicative of the predetermined waveform is read out as a first waveform signal "b" shown in FIG. 2 from the waveform memory 11*b* at a frequency defined by the frequency information FN.

Figure 2:
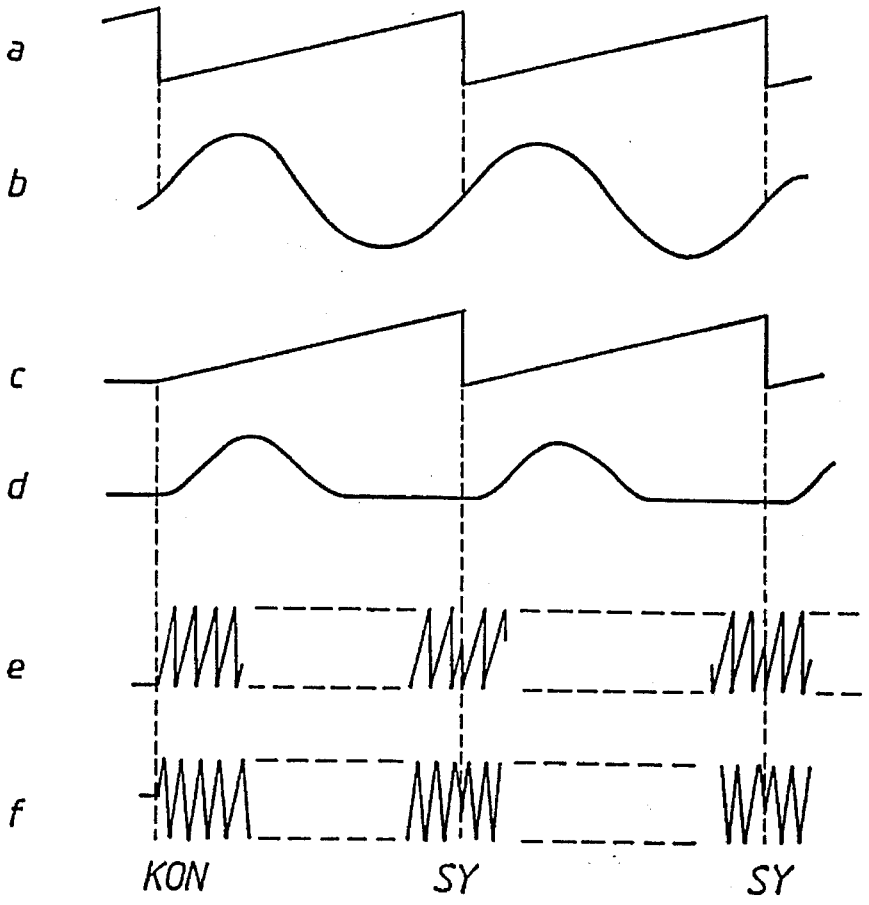
FIG. 2 illustrates waveform signals appearing at respective portions of the musical tone signal synthesizer shown in FIG. 1.

Similarly, the second waveform signal producing portion 12 is comprised of a phase data producing circuit 12*a* and a waveform memory 12*b*. The phase data producing circuit 12*a* includes an accumulator as a main component which is designed to accumulate frequency information FP applied thereto thereby to successively output a phase data "c" indicative of the accumulated values 0–2π as shown in FIG. 2. In this phase data producing circuit 12*a*. the value of frequency information FP is accumulated from an initial value (for instance, 0) in response to a key-on signal KON applied from the performance means such as the keyboard device, the automatic performance apparatus or the like to produce a synchronous signal SY per one cycle of the accumulation. The frequency information FP corresponds with a tone color designated by the tone color designation means such as the tone color selection device, the automatic performance apparatus or the like and represents a value proportional to a tone pitch frequency of a musical tone signal to be designated and generated by the performance means or integer times the tone pitch frequency. The frequency information FP may be represented by a different value even if it is represented by the same value as the frequency information FN. The waveform memory 12*b* is arranged to memorize a number of waveform sampling data indicative of a windowing function per one cycle. The sampling data are successively addressed by the phase data applied from the phase data producing circuit 12*a* through an adder 14*a* so that a waveform signal indicative of the windowing function is read out as a second waveform signal "d" from the waveform memory 12*b* at a frequency defined by the frequency information FP as shown in FIG. 2.

Similarly to the first and second waveform signal producing circuits 11 and 12, the third waveform signal producing circuit 13 is comprised of a phase data producing circuit 13*a* and a waveform memory 13*b*. The phase data producing circuit 18 includes an accumulator as a main component which accumulates frequency information FC applied thereto to successively output the accumulated frequency information as a phase data "e" indicative of 0–2π as shown in FIG. 2. The frequency information FC is designated by the tone color designation means such as the tone color selection device, the automatic performance apparatus or the like to represent a central frequency position of a fixed formant. The frequency information FC is represented as a larger value than the frequency information FN, FP. Thus, the production cycle of the phase data in the phase data producing circuit 13*a* is extremely shorter than that of The phase data by the phase data producing circuits 11*a*, 12*a*. In the phase data producing circuit 13*a*, the value of frequency information FC is accumulated from an initial value (for instance, 0) in response to the key-on signal KON and reset by the synchronous signal SY from the phase data producing circuit 12*a* to restart accumulation of the frequency information from the initial value. The waveform memory 13*b* is provided to memorize a number of sampling data indicative of a predetermined waveform (for instance, a sine wave) per one cycle. The sampling data are successively addressed by the phase data applied from the phase data producing circuit 13*a* through an adder 14*b* so that a waveform signal indicative of the predetermined waveform is read our as a third waveform signal "f" as shown in FIG. 2 from the waveform memory 13*b* at a frequency defined by the frequency information FC.

The adders 14*a*, 14*b* are adapted to add the waveform data from the waveform memory 11*b* to each phase data from the phase data producing circuits 12*a* and 13*a*. Since these adders 14*a*, 14*b* each act as a modulation means, the first waveform signal from the first waveform signal producing portion 11 is applied as a modulation signal, while the second and third waveform signals from the second and third waveform signal producing portions 12 and 13 each are applied with frequency modulation. The waveform memories 12*b* and 13*b* are connected to a multiplier 15 which multiplies the third waveform signal "f" from the third waveform signal producing portion 13 by the second waveform signal "d" from the second waveform signal producing portion 12 to output intermittently the third waveform signal in accordance with the windowing function represented by the second waveform signal. As shown by an arrow A in FIG. 3, the intermittent waveform signal has a fixed formant characteristic wherein the center of formant is located at a position of a frequency defined by the frequency information FC and wherein a plurality of higher harmonics are included at an interval of a frequency defined by the frequency information FP.

The multiplier 15 is connected to a multiplier 16 which is adapted to multiply the waveform signal from the multiplier 15 by an envelope waveform signal from an envelope waveform signal producing circuit 17. When applied with the key-on signal KON from the performance means and envelope information EGP from the tone color designation means, the envelope waveform signal producing circuit 17 produces an envelope waveform signal indicative of an amplitude envelope waveform of a musical tone signal and applies it to the multiplier 16.

Hereinafter, operation of the musical tone signal synthesizer will be described in detail. When the key-on signal KON, frequency information FN, FP, FC and envelope information EGP are produced by operation of the performance means and tone color designation means, the first waveform signal producing portion 11 outputs a first waveform signal "b" as shown in FIG. 2 at a frequency represented by the frequency information FN, while the second waveform signal producing circuit 12 produces a second waveform signal "d" as shown in FIG. 2 at a frequency defined by the frequency information FP as a carrier representing a windowing function modulated by the first waveform signal "b". In this instance, the third waveform signal producing circuit 13 produces a third waveform signal "f" as shown in FIG. 2 at a frequency defined by the frequency information FC as a carrier modulated by the first waveform signal "b". The second and third waveform signals "d" and "f" are multiplied by the multiplier is and applied as a fourth waveform signal to the multiplier 18.

Figure 3:
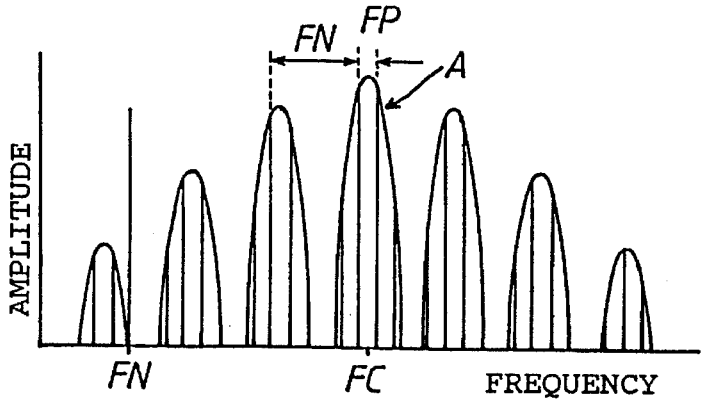
FIG. 3 is a spectrum envelope view showing the occurrence condition of plural formants in the musical tone signal synthesized by the musical tone signal synthesizer of FIG. 1.

During such operation of the musical tone signal synthesizer as described above, the envelope waveform producing circuit 17 produces an envelope waveform signal designated by the envelope information EGP in response to the key-on signal KON. Thus, the multiplier 18 multiplies the envelope waveform signal by the fourth waveform signal from the multiplier 15 to apply an amplitude envelope defined by the envelope waveform signal to the fourth waveform signal thereby to produce the fourth waveform signal as a musical tone signal. In the musical tone signal synthesizer, the fourth waveform signal becomes identical with a waveform signal modulated by the first waveform signal "b" since the adders 14*a*, 14*b* act to modulate the second and third waveform signals "d" and "f" by the first waveform signal "b". Before modulated by the first waveform signal, the fourth waveform signal is already in the form of a waveform signal which has a high level at a specific frequency region defined by the frequency information FC of the third waveform signal and includes a plurality of higher harmonics components. Thus, a plurality of side band waves occur at frequency positions shifted by the frequency of the first waveform signal from the respective higher harmonics components of the fourth waveform signal. As a result, the fourth waveform signal modulated by the first waveform signal is applied with a fixed formant characteristic comprised of a plurality of fixed formants as shown in FIG. 3.

Figure 4:
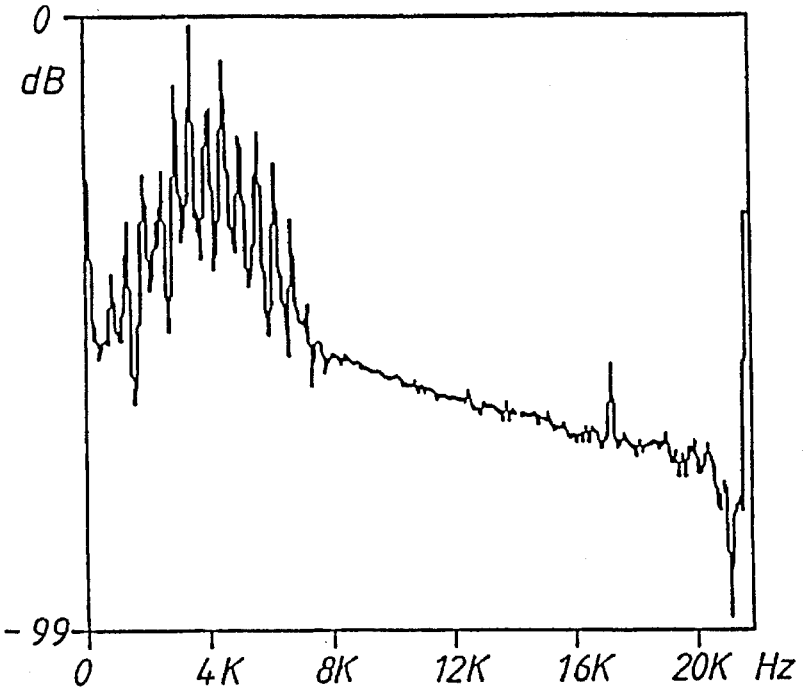
FIGS. 4(A) and 4(B) each are a spectrum envelope view showing an experimental result of synthesis of a musical tone signal by means of the musical tone signal synthesizer of FIG. 1.
Figure 4:
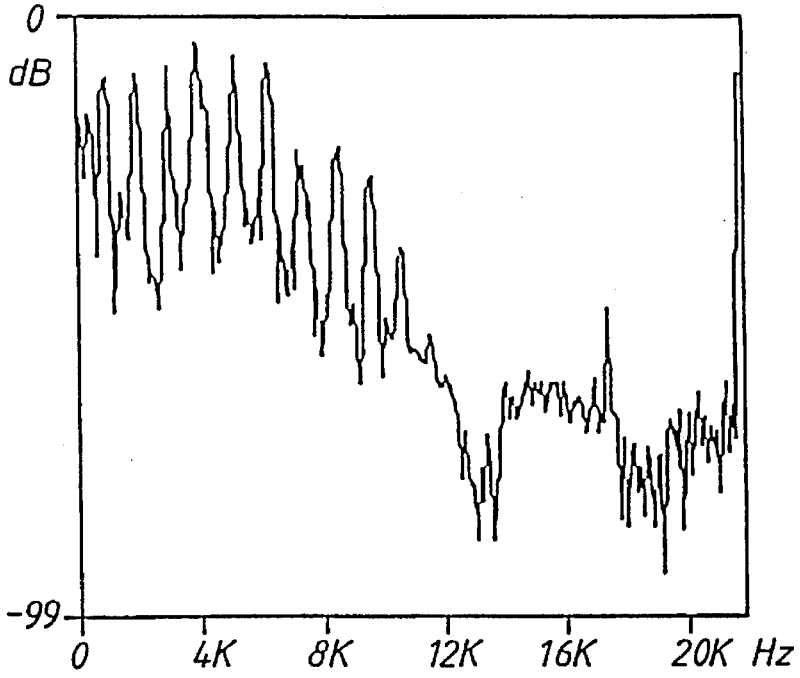

Illustrated in FIGS. 4(A) and 4(B) are spectrum envelopes of musical tone signals synthesized under conditions (1) and (2) listed in the following table 1.

TABLE 1

| | Condition (1) | Condition (2) |
|---|---|---|
| yFirst waveform signal: | | |
| Waveform | Sine wave | Sine wave |
| Frequency | 2200 Hz | 220 Hz |
| Amplitude level | −7 dB | −17 dB |
| Second waveform signal: | | |
| Waveform | Square sine wave | Square sine wave |
| Frequency | 220 Hz | 220 Hz |
| Band width | 50 Hz | 50 Hz |
| Third waveform signal: | | |
| Waveform | Sine wave | Sine wave |
| Frequency | 4009 Hz | 1008 Hz |
| Fourth waveform signal: | | |
| Amplitude level | 0 dB | 0 dB |

In the table 1, the band width of the second waveform signal represents a frequency width of 3 dB below a peak value in a formant of the waveform signal formed by multiplication of the third waveform signal and the second waveform signal (the windowing function).

From the above description, it will be understood that a musical tone signal of a fixed formant characteristic comprised of a plurality of fixed formants can be synthesized in a simple construction only by means of the second and third waveform signal producing portions 12 and 13, the multiplier 15 for forming the fourth waveform signal, the first waveform signal producing portion 11 and the adders 14*a*, 14*b* for modulating the fourth waveform signal. Since each frequency position of the fixed formants can be simply defined by each frequency of the first, second and third waveform signals (each frequency defined by the frequency information FN, FP and FC), a musical tone signal of a desired formant characteristic comprised of a plurality of fixed formants can be synthesized in a simple manner.

Although in the first embodiment of the musical tone signal synthesizer, all the first, second and third waveform signals have been modulated in frequency, either one of the waveform signals may be modulated in frequency to modulate the other waveform signals in frequency. In such a modification, either one of the adders 14*a* and 14*b* may be eliminated.

Figure 5:
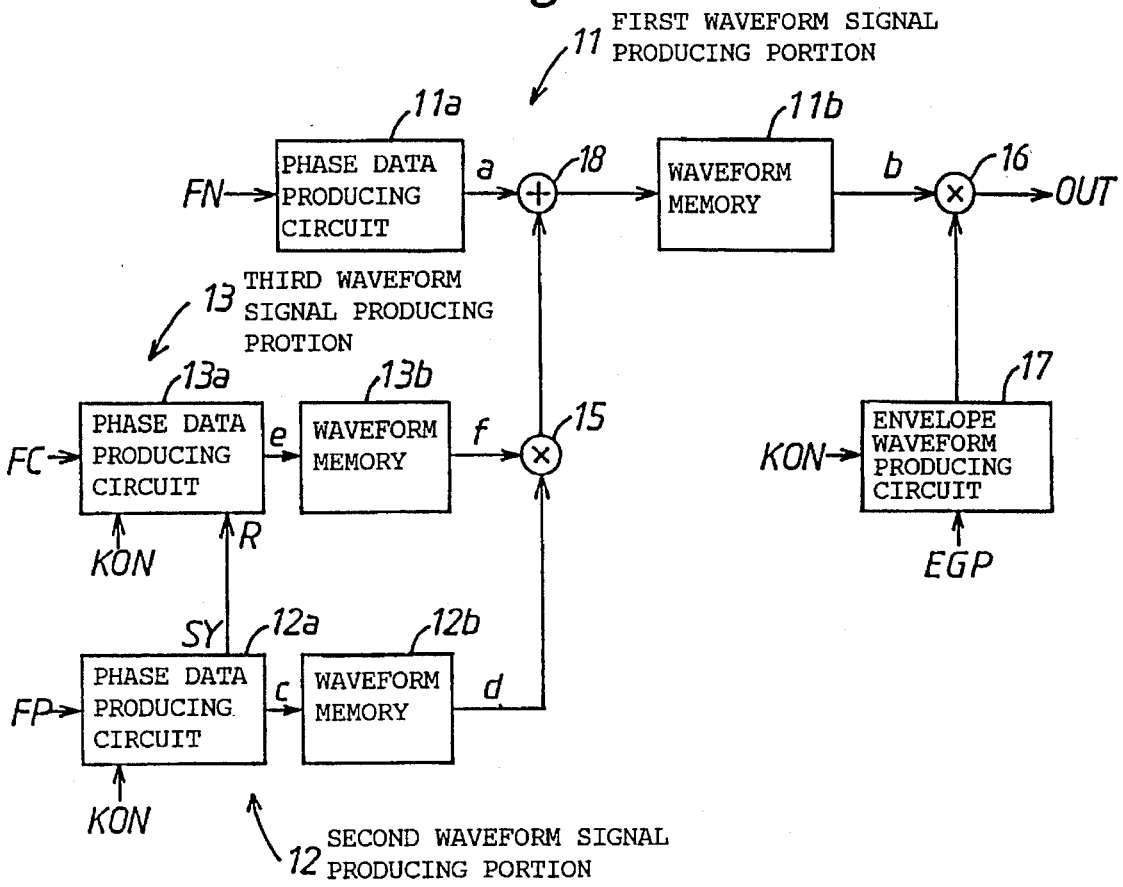
FIG. 5 is a block diagram of a second embodiment of a musical tone signal synthesizer in accordance with the present invention.

Illustrated in FIG. 5 is a second embodiment of a musical tone signal synthesizer in accordance with the present invention which includes first, second and third waveform signal producing portions 11, 12 and 13, multipliers 15 and 16 and an envelope waveform producing circuit 17 provided substantially in the same manner as in the first embodiment. In this second embodiment, the adders 14*a* and 14*b* of the first embodiment are replaced with an adder 18 which is adapted to add a fourth waveform signal in the form of an output signal of the multiplier 15 to a phase data applied from the phase data producing circuit 11*a*. The adder 18 acts as a modulation means for applying frequency modulation to the first waveform signal.

Assuming that in operation of the second embodiment, the performance means and tone color designation means such as the keyboard device and the tone color selection device have been operated to produce a key-on signal KON, frequency information FN, FP, FC and envelope information EGP, the second and third waveform signal producing portions 12 and 13 produce second and third waveform signals "d" and "f" as shown in FIG. 2 at each frequency defined by the frequency information FP, FC. The second and third waveform signals "d" and "f" are multiplied by the multiplier 15 and applied as a fourth waveform signal to the adder 18. On the other hand, the first waveform signal producing portion 11 produces a first waveform signal "b" as shown in FIG. 2 as a carrier at a frequency defined by the frequency information FN, and the adder 18 acts to modulate the first waveform signal "b" by the fourth waveform signal applied thereto from the multiplier 15. Thus, the multiplier 16 acts to multiply the modulated first waveform signal by an envelope waveform signal applied from the envelope waveform generating circuit 17 thereby to produce a musical tone signal with an amplitude envelope defined by the envelope waveform signal.

Figure 6:
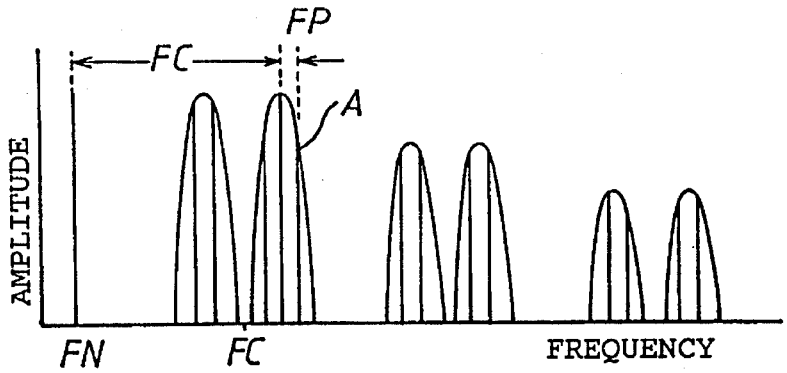
FIG. 6 is a spectrum envelope view showing the occurrence of plural formants in a musical tone signal synthesized by the musical tone signal synthesizer of FIG. 5.

In such a musical tone signal as described above, a plurality of side band waves occur at opposite sides of a frequency of the first waveform signal with an interval defined by the frequency of the fourth waveform signal. Provided that, the frequency component is inverted in phase. The fourth waveform signal is inherently in the form of a waveform signal having a fixed formant characteristic shown by the character A in FIG. 8 and including a plurality of higher harmonics components the level of which is higher at a specific frequency region. Thus, the formants included in the fourth waveform signal are aligned on a frequency axis, and the first waveform signal modulated by the fourth waveform signal becomes a waveform signal having a fixed formant characteristic comprised of the plural formants as shown in FIG. 6.

Figure 7:
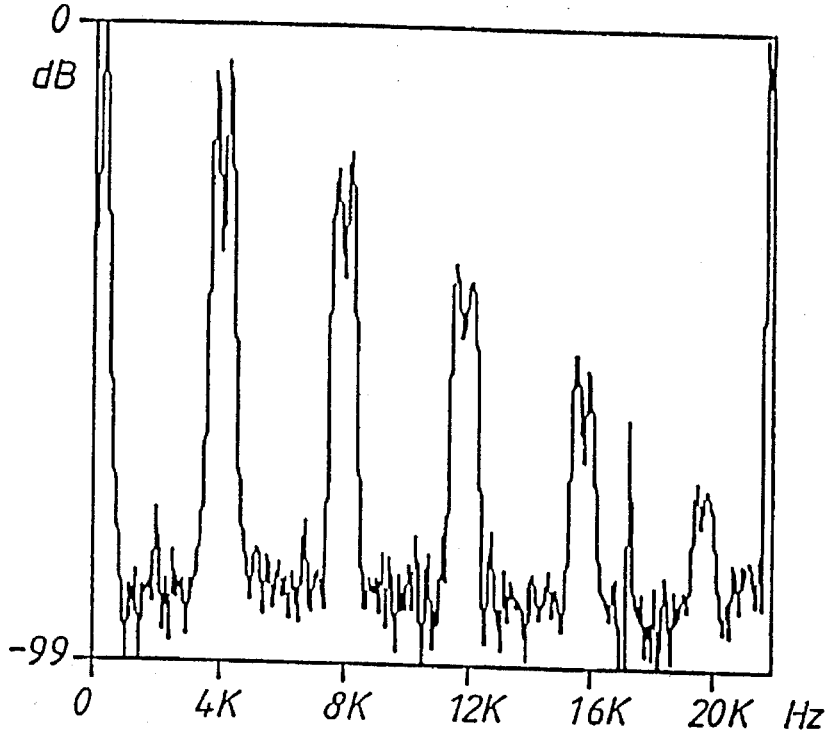
FIGS. 7(A) and 7(B) each are a spectrum envelope view showing an experimental result of synthesis of a musical tone signal by means of the musical tone signal synthesizer of FIG. 5.
Figure 7:
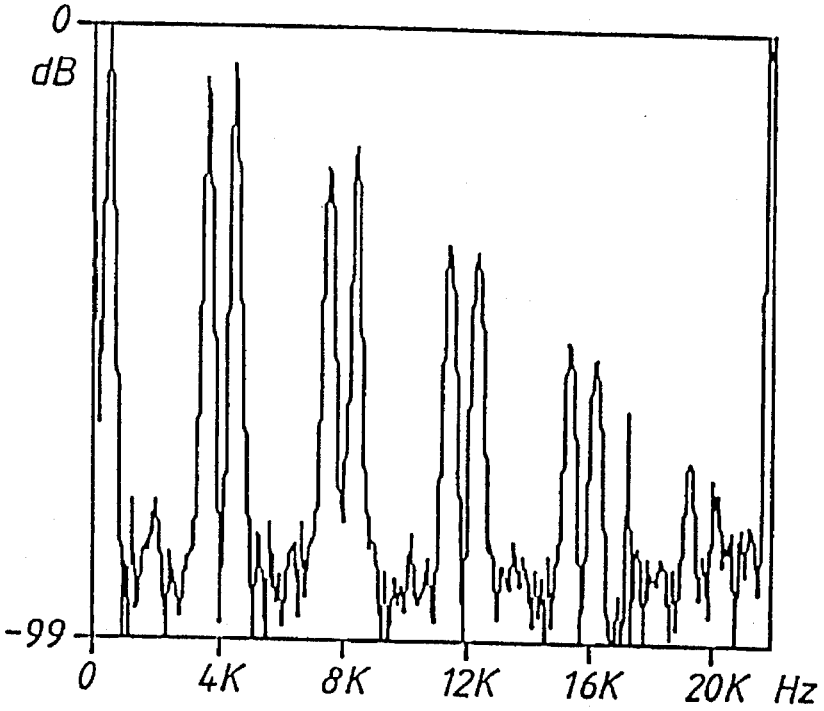

Illustrated in FIGS. 7(A) and 4(B) are spectrum envelopes of musical tone signals synthesized under conditions (1) and (2) listed in the following table 2.

TABLE 2

| | Condition (1) | Condition (2) |
|---|---|---|
| First waveform signal: | | |
| Waveform | Sine wave | Sine wave |
| Frequency | 220 Hz | 440 Hz |
| Amplitude level | −17 dB | −17 dB |
| Second waveform signal: | | |
| Waveform | Square sine wave | Square sine wave |
| Frequency | 110 Hz | 110 Hz |
| Band width | 50 Hz | 50 Hz |
| Third waveform signal: | | |
| Waveform | Sine wave | Sine wave |
| Frequency | 4009 Hz | 4009 Hz |
| Fourth waveform signal: | | |
| Amplitude level | 0 dB | 0 dB |

In the table 2, the band width of the second waveform signal is the same as in the first embodiment.

From the above description, it will be understood that in the second embodiment, a musical tone signal with a fixed formant characteristic comprised of a plurality of formants can be synthesized in a simple manner only by means of the second and third waveform signal producing portions 12 and 13, the multiplier 15 for forming the fourth waveform signal, the first waveform signal producing portion 11 for producing the musical tone signal modulated by the fourth waveform signal and the adder 18 for modulation of the musical tone signal. Since each frequency position of the plural formants is simply defined by each frequency of the first, second and third waveform signals (each frequency defined by the frequency information FN, FP, FC), a musical tone signal having a desired formant characteristic comprised of a plurality of fixed formants can be synthesized in a simple manner.

Although in the first and second embodiments, it is desirable that each frequency of the first and second waveform signals is set in a relationship of about integer times for obtaining a scale note, such a relationship between the first and second waveform signals is not required to obtain a musical effect tone other than the scale note, effect and alarm tones in a computer device, a game equipment or the like.

Although in the first and second embodiments, frequency modulation has been utilized, phase modulation of the fourth waveform signal (the second or third waveform signals) may be effected by the first waveform signal or phase modulation of the first waveform signal may be effected by the fourth waveform signal since a similar result can be obtained by either the phase or frequency modulation. In the case that a large number of formants are not required, amplitude modulation of the fourth waveform signal (the second or third waveform signal) or the first waveform signal may be effected by the first or fourth waveform signal.

Figure 8:
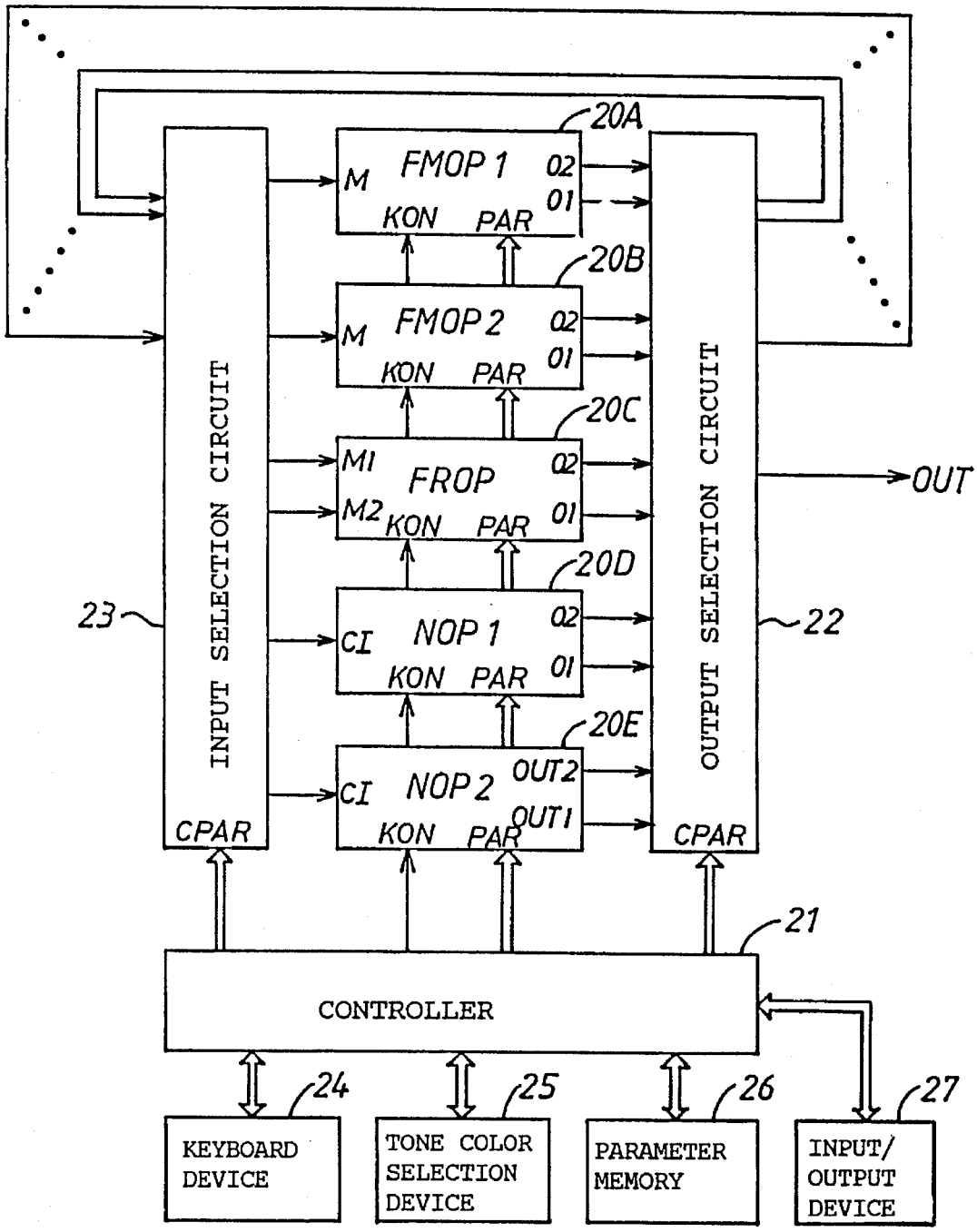
FIG. 8 is a block diagram of a practical embodiment of a musical tone signal synthesizer adapted to an electronic musical instrument.

Practical application:

Illustrated in FIG. 8 is a block diagram of an electronic musical instrument equipped with the musical tone signal synthesizer in accordance with the present invention. The electronic musical instrument includes five calculation units 20A–20E respectively for calculation of a waveform signal. The calculation units 20A–20E each are provided with an input terminal to be applied with various control parameters PAR for production of the waveform signal and a key-on signal KON from a controller 21 and output terminals 01, 02 for applying a calculated waveform signal to an output selection circuit 22. In addition, the calculation units 20A, 20B each are provided with an input terminal M to be applied with a modulation signal from an input selection circuit 23, the calculation unit 20C is provided with input terminals M1, M2 to be applied with the modulation signal from the input selection circuit 23, and the calculation units 20D, 20E each are provided with an input terminal CI to be applied a carrier signal from the input selection circuit 23.

The controller 21 is designed for control of the calculation units 20A–20E and the output and input selection circuits 22 and 23. In operation, the controller 21 applies a key-on signal KON to the calculation units 20A–20E in response to key performance on the keyboard device 24 and reads out the control parameters PAR and CPAR from the parameter memory 26 in accordance with a tone pitch designated by the key performance and a tone color selected by operation of the tone color selection device 25 to apply the control parameter FAR to the calculation units 20A–20E and to apply the control parameter CPAR to the output and input selection circuits 22 and 23. The controller 21 is connected to an external information input/output device 27 which controls the control parameters PAR and CPAR and key-on signal KON applied to and from another electronic musical instrument, an automatic performance apparatus and an acoustic instrument.

The output selection circuit 22 is adapted to select and/or mix waveform signals applied from the output terminals 01, 02 of each of the calculation units 20A–20E in accordance with the control parameter CPAR from the controller 21 thereby to output the selected and/or mixed waveform signals as a musical tone signal or feed back the selected and/or mixed waveform signals to the input selection circuit 23. The input selection circuit 23 is adapted to select and/or mix the feedback waveform signals and apply them to the input terminals M, M1, M2 of calculation units 20A–20C or the input terminals CI of calculation units 20D, 20E.

Figure 9:
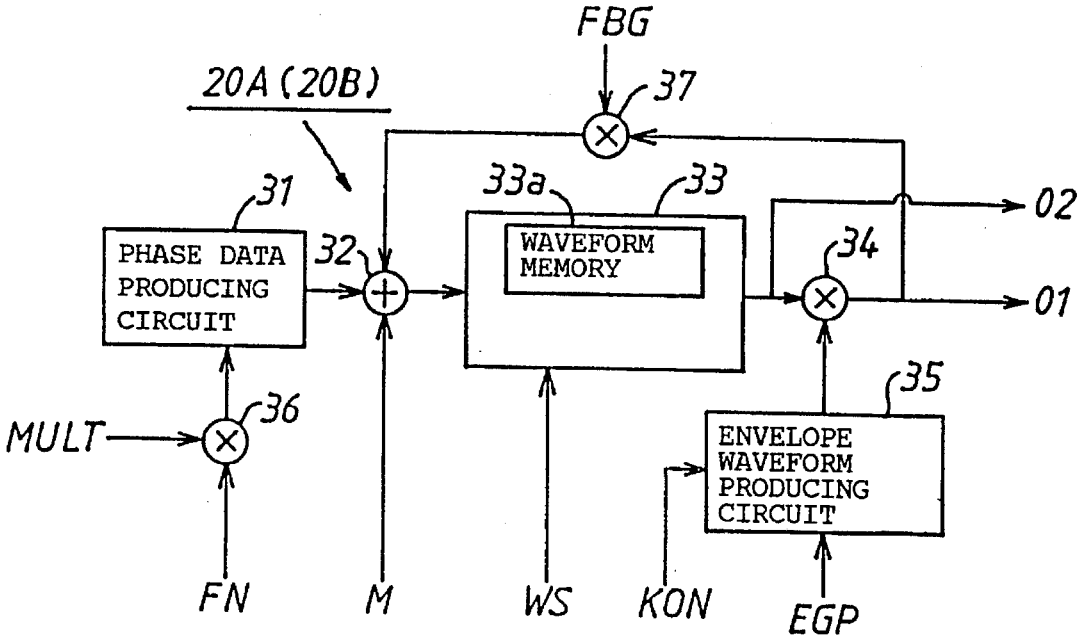
FIG. 9 is a block diagram of a practical embodiment of each of the calculation units 20A and 20B shown in FIG. 8.
Figure 10:
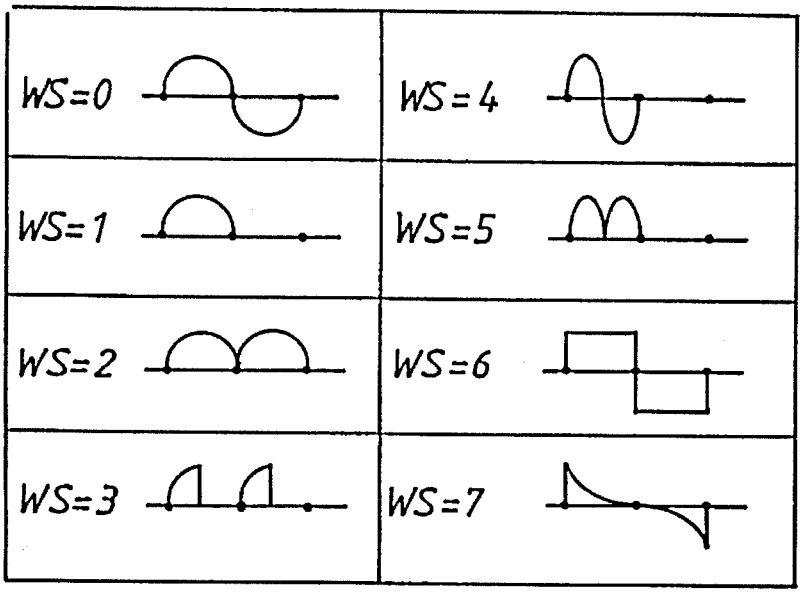
FIG. 10 illustrates various waveform signals produced by a standard waveform producing circuit shown in FIG. 9.

As shown in FIG. 9, each of the calculation units 20A–20B includes a phase data producing circuit 31, an adder 32, a waveform memory 33*a*, a multiplier 34 and an envelope waveform producing circuit 35 which correspond respectively with the phase data producing circuit 11*a*, adder 18, waveform memory 11*b*, multiplier 16 and envelope waveform producing circuit 17 in the second embodiment shown in FIG. 5. The phase data producing circuit 31 is connected to a multiplier 36 to be applied with a multiplied value MULT FN of the frequency information FN and frequency coefficient MULT for repeatedly producing a phase data at a cycle reversely proportional to the multiplied value MULT FN. The adder 32 is adapted to add a modulation signal applied from the exterior through the modulation wave input terminal M to the phase data from the phase data producing circuit 31 and to add a waveform signal fed back from the multiplier 34 through a multiplier 37 to the phase data. With such arrangement of the adder 32, a feedback frequency modulation can be effected, and the feedback amount of the waveform signal is determined by a feedback gain FBG applied to the multiplier The waveform memory 33*a* is included in a standard waveform producing circuit 33 to be addressed by the phase data from the phase data producing circuit 31. The standard waveform producing circuit 33 further includes various kinds of calculation circuits and a selection circuit other than the waveform memory 33*a* to selectively produce various kinds of waveform signals in accordance with waveform selection information WS applied thereto as shown in FIG. 10. The multiplier 34 is adapted to apply an amplitude envelope to an output waveform signal of the standard waveform producing circuit 33 in response to an envelope waveform signal produced by the envelope waveform producing circuit 35. The waveform signal with the amplitude envelope is output through the output terminal 01. The output waveform signal of the standard waveform producing circuit 33 is also output through the output terminal 02 without being applied with any amplitude envelope. The control parameter PAR supplied from the controller 21 includes the frequency information FN, frequency coefficient MULT, waveform selection information WS, envelope information EGP and feedback gain FBG. Thus, the calculation units 20A, 20B each are responsive to the key-on signal to produce a waveform signal having a frequency defined the frequency information FN and coefficient MULT and a higher harmonics component corresponding with the waveform selection information WS and to modulate the produced waveform signal by the modulation signal and/or the feedback signal applied to the modulation wave input terminal M for producing various kinds of waveform signals with an amplitude envelope.

Figure 11:
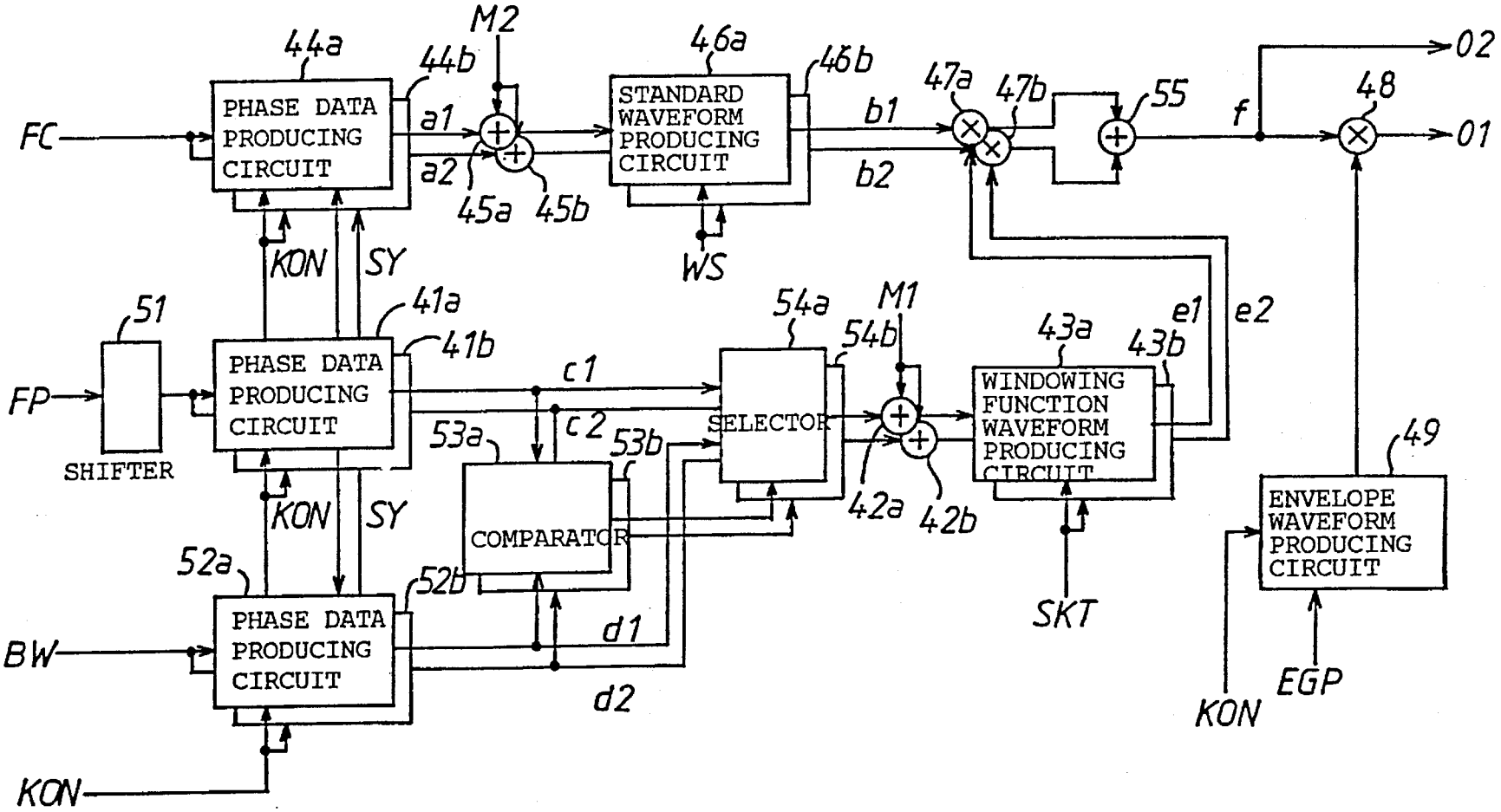
FIG. 11 is a block diagram of a practical embodiment of a calculation unit 20C shown in FIG. 8.

As shown in FIG. 11, the calculation unit 20C includes phase data producing circuits 41*a*, 41*b*, adders 42*a*, 42*b*, windowing function waveform producing circuits 43*a*, 43*b*, phase data producing circuits 44*a*, 44*b*, adders 45*a*, 45*b*, standard waveform producing circuits 46*a*, 46*b*, multipliers 47*a*, 47*b*, a multiplier 48 and an envelope waveform producing circuit 49 which correspond respectively with the phase data producing circuit 12, adder 14*a*, waveform memory 12*b*, phase data producing circuit 13*a*, adder 14*b*, waveform memory 13*b*, multiplier 15, multiplier 16 and envelope waveform generating circuit 17 in the first embodiment shown in FIG. 1. In this calculation unit 20C, the windowing function waveform producing circuits 43*a*, 43*b* each include a waveform memory addressed by phase data "c1", "c2", "d1", "d2" shown in FIG. 12 as in the respective standard waveform producing circuits 33 of the calculation units 20A, 20B and a calculation circuit for converting an output waveform of the waveform memory. With the waveform memory and calculation circuit, the windowing function waveform producing circuit 43*a*, 43*b* each act to produce a windowing function waveform signal indicative "$\sin^{2\,SKT}(x/2)$" as shown by the characters "c1", "c2" in FIG. 12. In the windowing function waveform signals, the character x represents a phase data and the character SKT represents a control information for controlling a skirt portion of the windowing function waveform in such a manner that a spectrum envelope of a fixed formant becomes narrow in width in accordance with an increase of the skirt portion. The standard waveform producing circuits 46*a*, 46*b* each are composed in the same construction as those in the calculation units 20A, 20B to produce waveform signals "b1", "b2" shown in FIG. 12 in accordance with the phase data "a1", "a2" and the waveform selection information WS.

Figure 12:
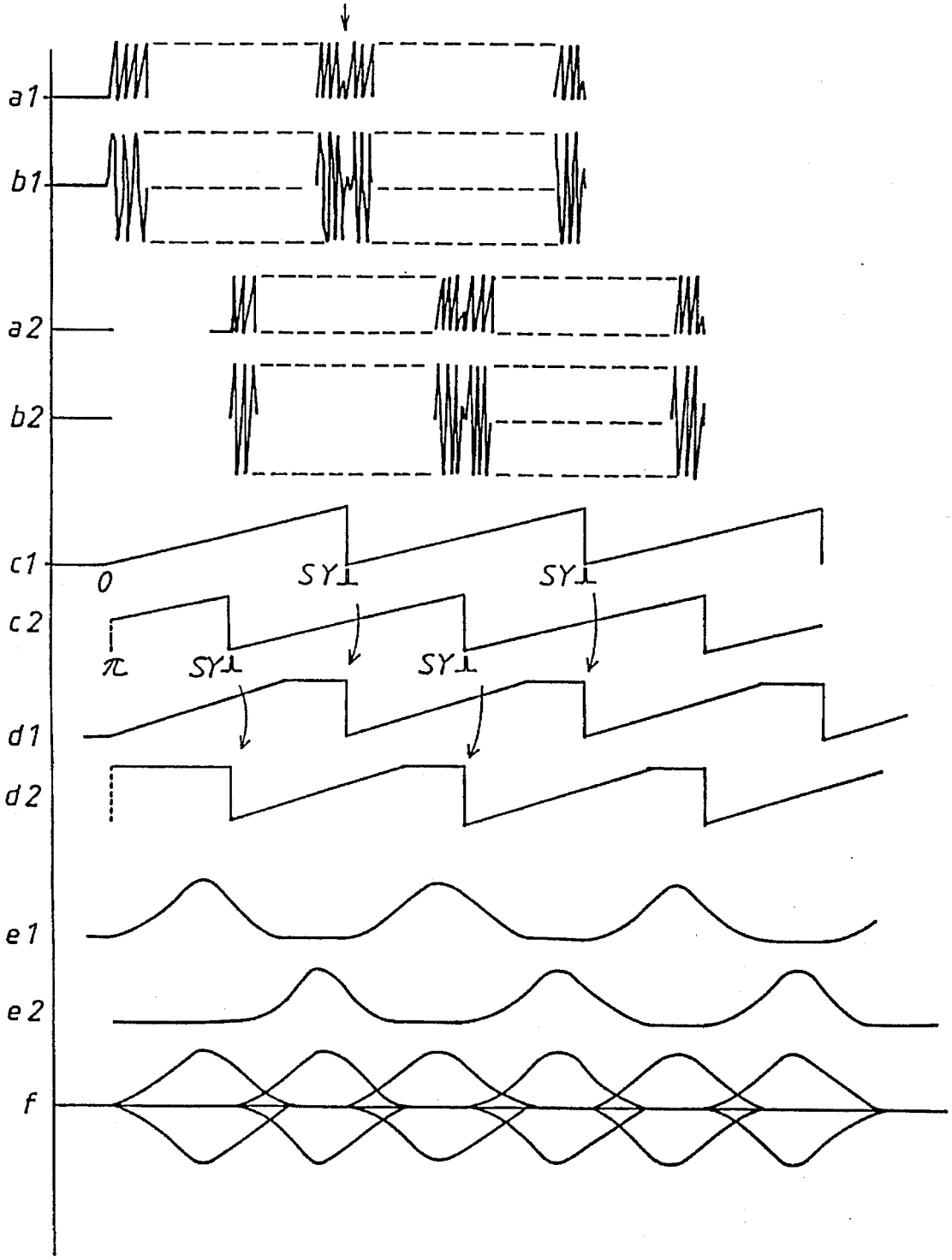
FIG. 12 illustrates signal waveforms at respective portions shown in FIG. 8 for explanation of operation of the calculation unit 20C.
Figure 13:
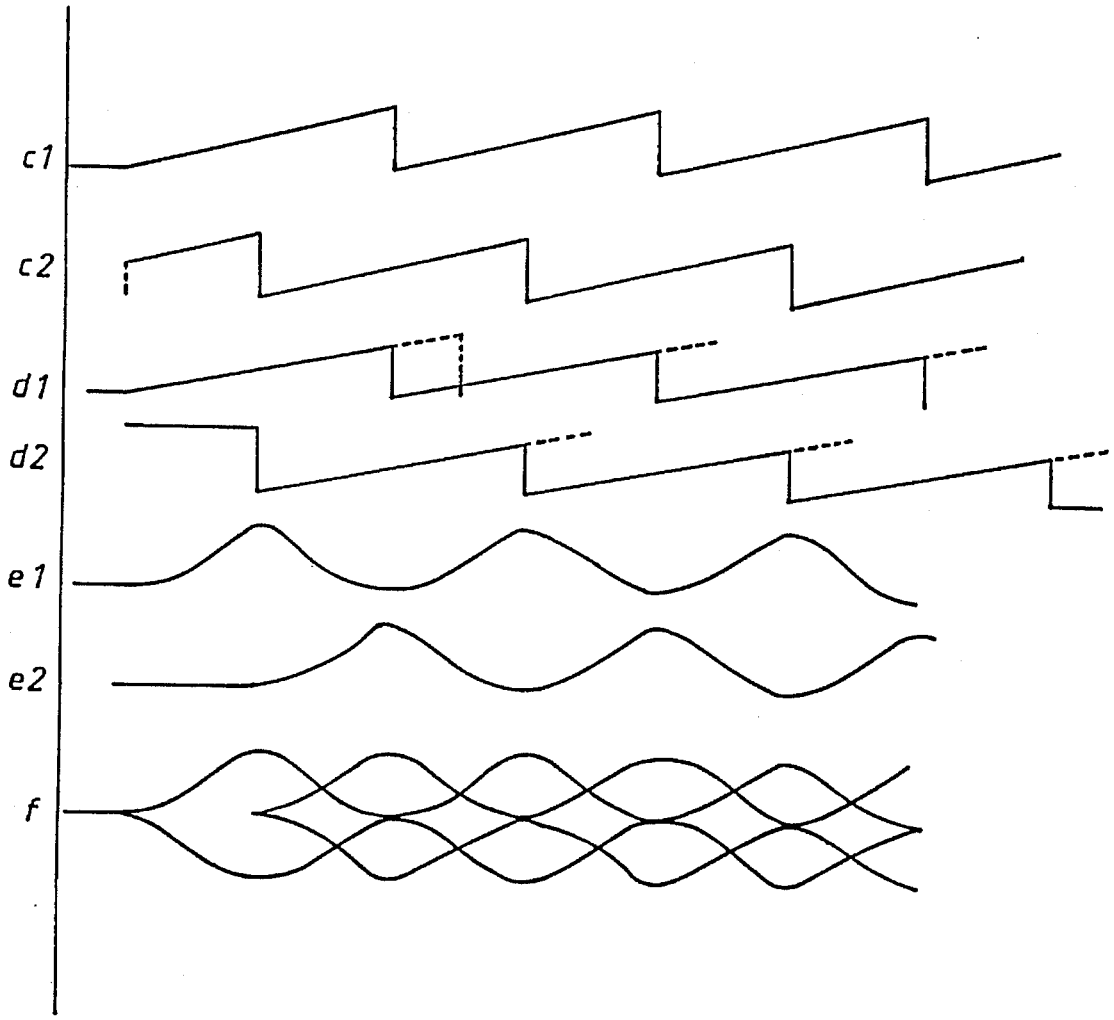
FIG. 13 illustrates signal waveforms at respective portions shown in FIG. 8 for explanation of operation of the calculation unit 20C.

In the calculation unit 20C, each circuit for producing the waveform signal having the fixed formant characteristic is provided respectively in pairs so that the time width of the windowing function can be set by two times a cycle defined by the frequency information FP. For the purpose of setting the time width of the windowing function, the frequency information FP is shifted down by one bit by means of a shifter 51 so that the pair of phase data producing circuits 41*a*, 41*b* each act to produce a synchronous signal SY and phase data "c1", "c2" different in a phase of $\pi$ as shown in FIG. 12. Additionally, a pair of phase data producing circuits 52*a*, 52*b* are provided to continuously change the time width of the windowing function. The phase data producing circuits 82*a*, 52*b* are applied with time width information BW for successively accumulating the time width information BW. When the time width information is accumulated up to a predetermined maximum value (corresponding with a maximum address or the waveform memory in the respective windowing function waveform producing circuits 43*a*, 43*b*), the phase data producing circuits 52*a*, 52*b* cease accumulation of the time width information and restart to accumulate the time width information from an initial value (for instance, "0") in response to the synchronous signals SY applied from the phase data producing circuits 41*a*, 41*b*.

A pair of comparators 53*a*, 53*b* are provided to compare the phase data from the phase data producing circuits 41*a*, 41*b* with the phase data from the phase data producing circuits 52*a*, 52*b* for producing a high level signal "1" when the latter phase data are more than the former phase data and for producing a low level signal "0" when the latter phase data are less than the former phase data. A pair of selector circuits 54*a*, 54*b* are provided to select the phase data of the phase data producing circuits 52*a*, 52*b* when applied with the high level signal "1" and to select the phase data of the phase data producing circuits 41*a*, 41*b* when applied with the low level signal "0".

Accordingly, if the time width information is less than two times the cycle defined by the frequency information FP, the inclination of the phase data "d1", "d2" from the phase data producing circuits 52*a*, 52*b* increases more than that of the phase data "c1", "c2" from the phase data producing circuits 41*a*, 41*b* as shown in FIG. 12. As a result, the selector circuits 54*a*, 54*b* act to apply the phase data from the phase data producing circuits 52*a*, 52*b* as an address signal to the windowing function producing circuits 43*a*, 43*b* through the adders 42*a*, 42*b*. If the time width information BW is more than two times the cycle defined by the frequency information FP, the inclination of the phase data "c1", "c2" from the phase data producing circuits 41*a*, 41*b* increases more than that of the phase data "d1", "d2" from the phase data producing circuits 52*a*, 52*b*. In this instance, the selector circuits 54*a*, 54*b* act to apply the phase data from the phase data producing circuits 41*a*, 41*b* as an address signal to the windowing function waveform producing circuits 43*a*, 43*b* through the adders 42*a*, 42*b*. Thus, the time width of the windowing function is variably controlled in such a manner that the maximum time width of the windowing function is variably controlled to be two times the cycle defined by the frequency information FP. To further prolong the maximum time width of the windowing function, the respective circuits in the calculation unit 20C are provided in more than three pairs.

In the calculation unit 20C composed in pairs, a waveform signal of a frequency defined by the frequency information FC is intermittently output from each of the multipliers 47*a*, 47*b* in response to a windowing function waveform signal at a cycle of two times the cycle defined by the frequency information FP. Both the output waveform signals are modulated by each modulation signal supplied to the modulation wave input terminals M1, M2 under control of the adders 42*a*, 42*b*: 45*a*, 45*b*. When output signals of the multipliers 47*a*, 47*b* are mixed at an adder 55, the waveform signal is intermittently produced at the cycle defined by the frequency information FP.

The output waveform signal of the adder 55 is output from the output terminal 01 after applied with an amplitude envelope in response to an envelope waveform signal produced by the envelope waveform signal producing circuit 49. The output waveform signal of the adder 55 is also output from the output terminal 02 without being applied with any amplitude envelope. The control parameter supplied from the controller 21 includes the frequency information FC, FP, time width information BW, skirt portion control information SKT, waveform selection information WS and envelope information EGP. Thus, the calculation unit 20C is responsive to the key-on signal KON to produce a waveform signal having a fixed formant characteristic defined by the frequency information FC, time width information BW and skirt portion control information SKT and a plurality of higher harmonics components defined by the frequency information FP and waveform selection signal WS and to modulate the produced waveform signal by the modulation signal applied to the modulation wave input terminals M1 and M2 for producing various modulated waveform signals with an amplitude envelope.

Figure 14:
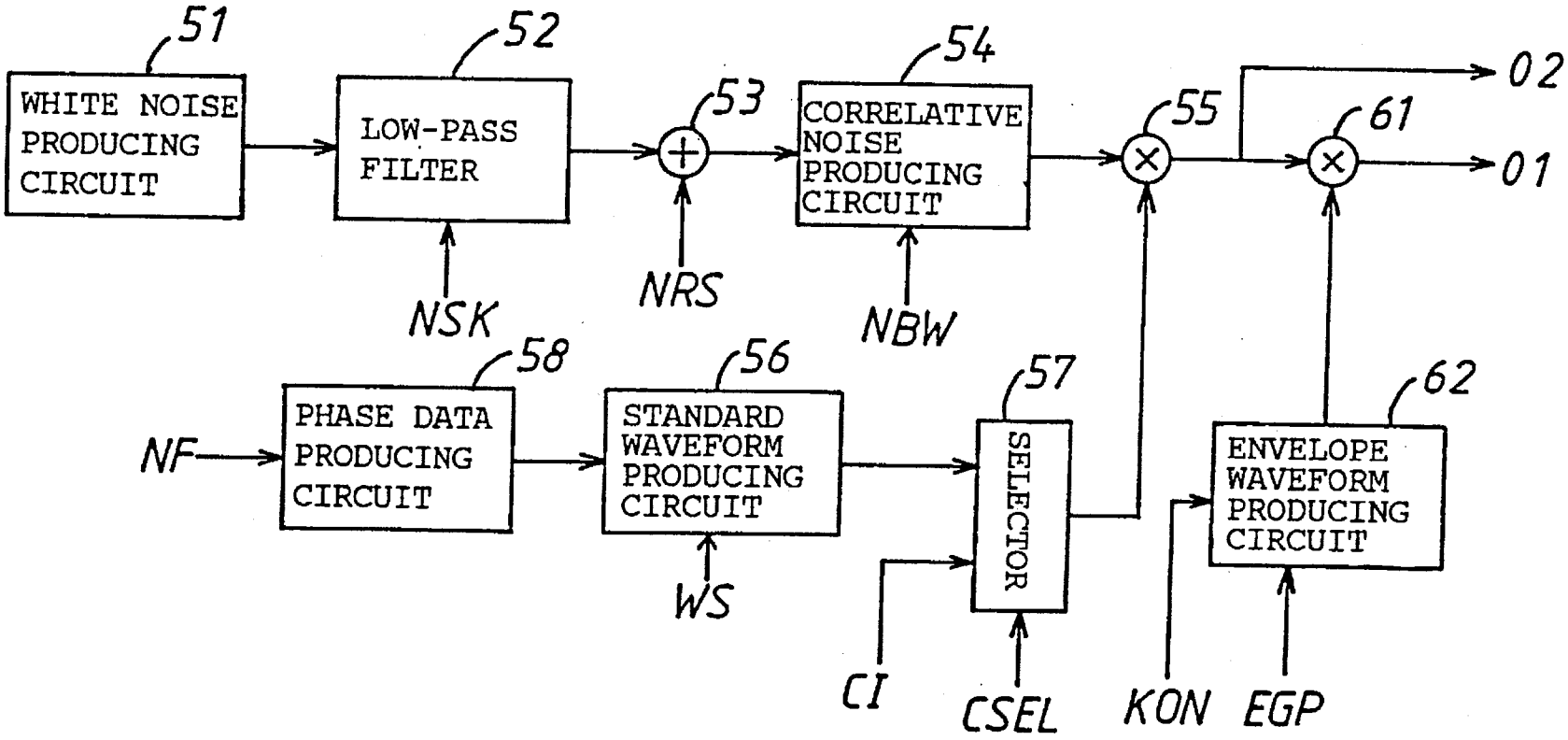
FIG. 14 is a block diagram of a practical embodiment of each of the calculation units 20D and 20E shown in FIG. 8.

As shown in FIG. 14, the calculation units 20D and 20E each are provided with a white noise producing circuit 51 for producing a white noise. The white noise from the white noise producing circuit 51 is supplied to a multiplier 55 through a low-pass filter 52, an adder 53 and a correlative noise producing circuit 54. The low-pass filter 52 is adapted to pass only a low frequency component included in the white noise therethrough for producing a noise signal having a formant at a low frequency region. With the low-pass filter 52, the skirt portion of the formant at the low frequency region can be controlled by the skirt portion control information NSK. The adder 53 is adapted to add a direct current component NRS to the white noise passing through the low-pass filter 52 for rising a peak of the formant. The magnitude of the formant peak is determined by the direct current component NRS. The correlative noise producing circuit 54 is adapted to apply correlation to the noise applied with the direct current component NRS for further changing the formant characteristic. The band width of the formant is variably controlled by band width information NBW.

The multiplier 55 is applied with a waveform signal from a standard waveform producing circuit 56 through a selector circuit 56 or a carrier signal from the selector circuit 56. The standard waveform producing circuit 56 is the same as the standard waveform producing circuit 33 in the calculation units 20A, 20B, which is addressed by a phase data from a phase data producing circuit 56 to read out a waveform signal therefrom and to change the read out waveform signal in accordance with the waveform selection information WS. The phase data producing circuit 58 is the same the phase data producing circuit 31 in each of the calculation units 20A, 20B, which is adapted to repeatedly produce a phase data at a cycle defined by the frequency information NF. The selector circuit 57 is adapted to selectively output a carrier signal applied at its input terminal CI in response to carrier wave selection information CSEL of high level "1" and to selectively output a waveform signal from the standard waveform producing circuit 56. The multiplier 55 is adapted to multiply the noise signal from the correlative noise producing circuit 54 by the waveform signal from the selector circuit 57. Thus, a noise signal having the formant is obtained at a position adjacent the frequency position of the waveform signal from the selector circuit 57.

The output of multiplier 55 is multiplied at a multiplier by an envelope waveform signal produced by the envelope waveform producing circuit 62 and is output from the output terminal 01. The output signal of multiplier 55 is output from the output terminal 02 without being applied with any amplitude envelope. The control parameter PAR supplied from the controller 21 includes the skirt portion control information NSK, direct current component NRS, band width information NBW, waveform selection information WS, carrier wave selection information CSEL, frequency information NF and envelope information EGP. Thus, the calculation units 20D, 20E each are responsive to the key-on signal KON to produce a noise signal having a fixed formant characteristic defined by the skirt portion control information NSK, direct current component NRS and band width information NBW at a frequency position defined by the frequency information NF and waveform selection signal WS or a frequency position of the carrier signal applied at its carrier wave input terminal CI and to output the noise signal after applied with an amplitude envelope.

Figure 15:
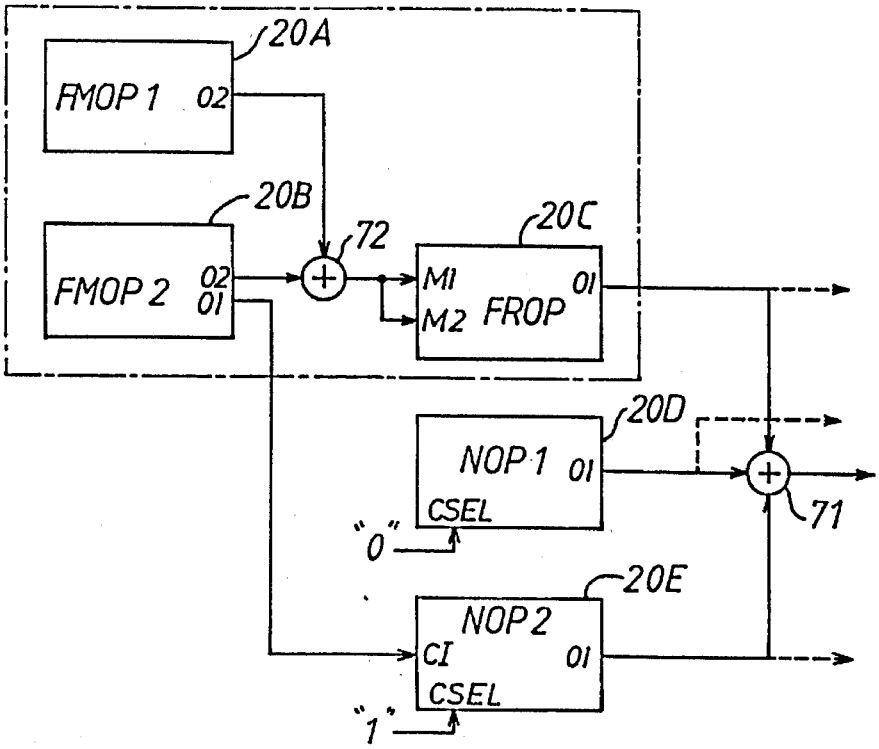
FIG. 15 is a functional block diagram of a first example showing a connected condition of the calculation units 20A–20E.
Figure 16:
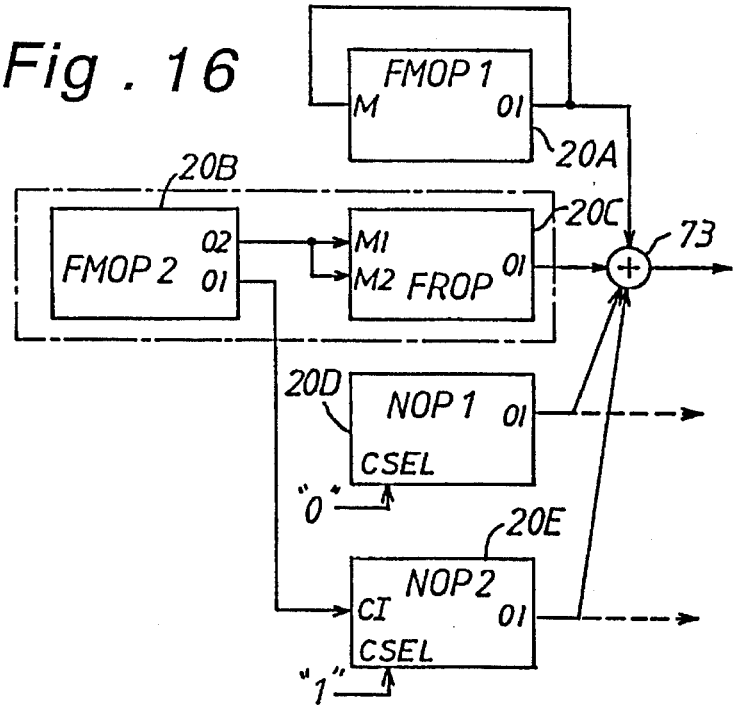
FIG. 16 is a functional block diagram of a second example showing a connected condition of the calculation units 20A–20E.

Assuming that in operation of the electronic musical instrument described above, the controller 21 has been applied with a selection signal indicative of a tone color from the external information input/output device 27, the controller 21 reads out the control parameters PAR, CPAR from the parameter memory 26 to supply the control parameter PAR to the calculation units 20A–20E respectively and to supply the control parameter CPAR to the output and input selection circuits 22 and 23. In response to the control parameter CPAR, the output and input selection circuits 22 and 23 act to connect the calculation units 20A–20E as shown in FIG. 15. Thus, the calculation units 20A–20E each are conditioned to execute calculation of waveform signals applied thereto in accordance with the control parameter PAR. In such a connected condition of the calculation units 20A–20E, an adder 71 is contained in the output selection circuit 22 to mix waveform signals applied thereto, and an adder 72 is contained in the output selection circuit 22 or the input selection circuit 23 to mix waveform signals applied thereto.

When applied with a key-on signal KON indicative of designation of a musical tone signal from the keyboard device 24 or the external information input/output device 27, the calculation units 20A–20E are activated. In the connected condition shown in FIG. 15, waveform signals produced by the calculation units 20A and 20B are mixed at the adder 72 and supplied to the modulation wave input terminals M1 and M2 of the calculation unit 20C. Thus, a waveform signal of a fixed formant characteristic is produced by the calculation unit 20C and modulated in frequency by the mixed waveform signals from the calculation units 20A and 20B to output a waveform signal having a fixed formant characteristic comprised of a plurality of formants through the adder 71. In this instance, noise signals each having a formant characteristic from the calculation units 20D and 20E are mixed with the output waveform signal from the calculation unit 20E at the adder 71. In addition, the output waveform signal and noise signals may be independently output as shown by broken lines in FIG. 15.

Figure 18:
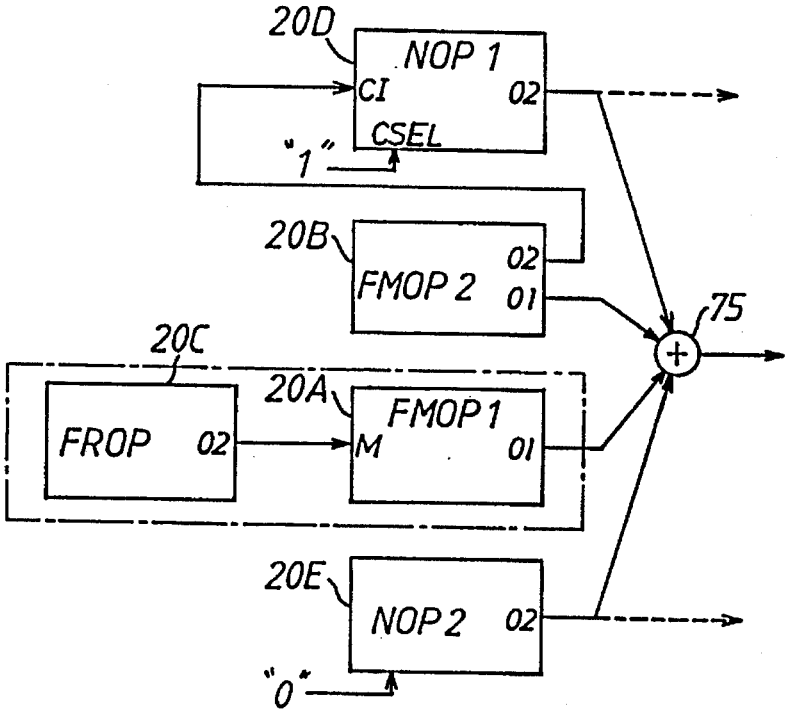
FIG. 18 is a functional block diagram of a fourth example showing a connected condition of the calculation units 20A–20E.

When the controller 21 is applied with a selection signal indicative of another tone color, the calculation units 20A–20E are connected as shown in FIG. 18. In such a connected condition as shown in FIG. 18, an adder 73 is contained in the output selection circuit 22 to mix output waveform signals from the calculation units 20A, 20C, 20D and 20E. In this instance, a waveform signal of a fixed formant characteristic produced by the calculation unit 20C is modulated in frequency by a waveform signal from the calculation unit 20B to output a waveform signal having a fixed formant characteristic comprised of a plurality of formants through the adder 73 as in the first embodiment.

Figure 17:
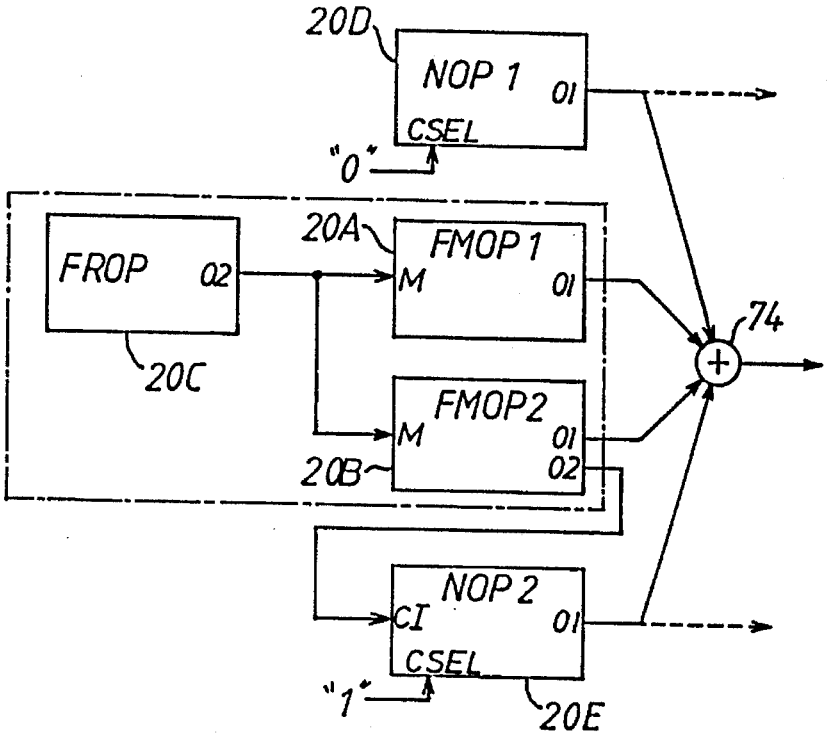
FIG. 17 is a functional block diagram of a third example showing a connected condition of the calculation units 20A–20E.

When the controller 21 is applied with a selection signal indicative of another tone color, the calculation units 20A–20E are connected as shown in FIG. 17 or 18. In such a connected condition as shown in FIG. 17 or 18, an adder 74 or 75 is contained in the output selection circuit 22 to mix output waveform signals from the calculation units 20A, 20B, 20D and 20E. In this instance, the waveform signals produced by the calculation units 20A, 20B or the waveform signal produced by the calculation unit 20A are modulated in frequency by the waveform signal having a fixed formant characteristic from the calculation unit 20C so that a waveform signal having a fixed formant characteristic comprised of a plurality of formants is output through the adder 74 or 75.

Figure 19:
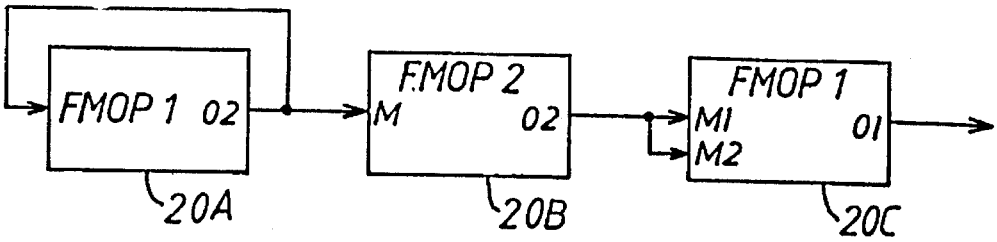
FIG. 19 is a functional block diagram of a fifth example showing a connected condition of the calculation units 20A–20E.
Figure 20:
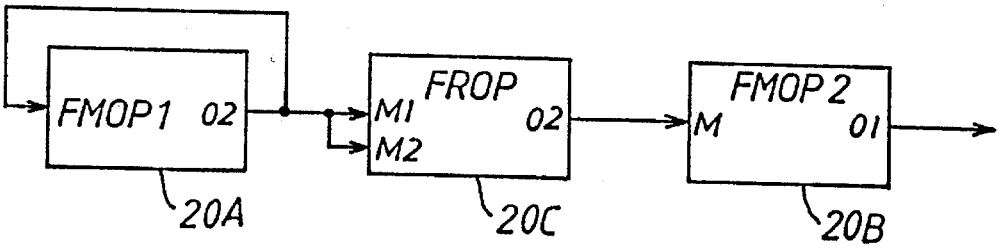
FIG. 20 is a functional block diagram of a sixth example showing a connected condition of the calculation units 20A–20E.

When the controller 21 is applied with a selection signal indicative of another tone color, the calculation units 20A–20C are connected in series as shown in FIG. 19. In such a connected condition as shown in FIG. 19, an output waveform signal of the calculation unit 20B is modulated in frequency by a waveform signal produced by the calculation unit 20A, and a waveform signal of a fixed formant characteristic produced by the calculation unit 20C is modulated in frequency by the modulated waveform signal from the calculation unit 20B. In a connected condition shown in FIG. 20, a waveform signal of a fixed formant characteristic produced by the calculation unit 20C is modulated in frequency by a waveform signal applied from the calculation unit 20A, and a waveform signal produced by the calculation unit 20B is modulated in frequency by the modulated waveform signal from the calculation unit 20C. Accordingly, in the connected condition shown in FIG. 19 or 20, it is able to synthesize a musical tone signal having a fixed formant characteristic comprised of more complicated formants than those in the first and second embodiments.

Figure 21:
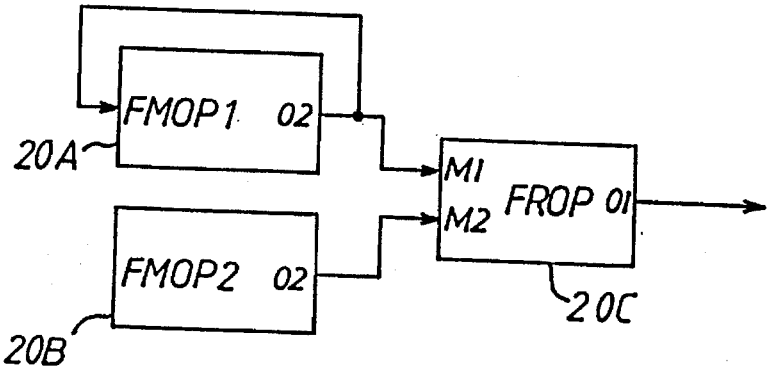
FIG. 21 is a functional block diagram of a seventh example showing a connected condition of the calculation units 20A–20E.

In the case that the calculation units 20A–20C are connected as shown in FIG. 21, a waveform signal produced by the calculation unit 20C is modulated in frequency by waveform signals produced by the calculation unit 20A and 20B. In this instance, the calculation unit 20C is applied with different waveform signals at its modulation wave input terminals M1 and M2. Thus, a musical tone signal having a fixed formant characteristic comprised of complicated formants can be synthesized.

Consequently, in the electronic musical instrument, a waveform signal having a fixed formant characteristic comprised of complicated formants can be obtained in a simple manner as in the first and second embodiments. In the electronic musical instrument, the calculation units 20A–20D can be selectively connected in various conditions by means of function of the output selection circuit 22 and input selection circuit 23. This is useful to synthesize various kinds of musical tone signals in the form of a waveform signal having a fixed formant characteristic comprised of complicated formants in a simple manner.

Although in the foregoing embodiments and application the calculation unit 20C has been adapted to produce a waveform signal of a fixed formant characteristic, a plurality of the calculation units may be provided to modulate in frequency a waveform signal of a fixed formant characteristic by a waveform signal of a fixed formant characteristic. In addition, the frequency modulation may be replaced with phase modulation or amplitude modulation.

Although in the foregoing embodiments, the calculation units 20A–20E each have been composed of a hard circuit, the calculation units each may be composed of a digital signal processing circuit the calculation of which is executed by a microcomputer. Alternatively, the calculation units 20A–20E each may be composed of a calculation circuit of the time divisional multi-channel type to simultaneously synthesize a plurality of musical tone signals.

Although in the foregoing embodiments, the control parameters PAR, CPAR changed in accordance with designation of a tone pitch and a tone color, the control parameters PAR, CPAR may be controlled by key touch, designation of a tone volume or a breath pressure.

What is claimed is:

1. A musical tone signal synthesizer comprising:

first waveform signal producing means for producing a first waveform signal of a frequency defined by first frequency information applied thereto;

second waveform signal producing means for producing a second waveform signal indicative of a windowing function at a cycle defined by second frequency information applied thereto;

third waveform signal producing means arranged to he synchronously controlled by said second waveform producing means for repeatedly producing a third waveform signal starting from a predetermined phase at each cycle of the second waveform signal at a shorter cycle than that of the second waveform signal;

modulation means for applying the first waveform signal as a modulation signal to said second waveform signal producing means for modulation of the second waveform signal; and means for multiplying the second and third waveform signals to produce a fourth waveform signal as a musical tone signal.

2. A musical tone signal synthesizer comprising:

first waveform signal producing means for producing a first waveform signal of a frequency defined by first frequency information applied thereto;

second waveform signal producing means for producing a second waveform signal indicative of a windowing function at a cycle defined by second frequency information applied thereto:

third waveform signal producing means arranged to be synchronously controlled by said second waveform producing means for repeatedly producing a third waveform signal starting from a predetermined phase at each cycle of the second waveform signal at a shorter cycle than that of the second waveform signal;

modulation means for applying the first waveform signal as a modulation signal to said third waveform signal producing means for modulation of the third waveform signal; and means for multiplying the second and third waveform signals to produce a fourth waveform signal as a musical tone signal.

3. A musical tone signal synthesizer comprising:

first waveform signal producing means for producing a first waveform signal of a frequency defined by first frequency information applied thereto;

second waveform signal producing means for producing a second waveform signal indicative of a windowing function at a cycle defined by second frequency information applied thereto;

third waveform signal producing means arranged to be synchronously controlled by said second waveform producing means for repeatedly producing a third waveform signal starting from a predetermined phase at each cycle of the second waveform signal at a shorter cycle than that of the second waveform signal;

first modulation means for applying the first waveform signal as a modulation signal to said second waveform signal producing means for modulation of the second waveform signal;

second modulation means for applying the first waveform signal as a modulation signal to said third waveform signal producing means for modulation of the third waveform signal; and means for multiplying the second and third waveform signals to produce a fourth waveform signal as a musical tone signal.

4. A musical tone signal synthesizer comprising:

first waveform signal producing means for producing a first waveform signal of a frequency defined by first frequency information applied thereto;

second waveform signal producing means for producing a second waveform signal indicative of a windowing function at a cycle defined by second frequency information applied thereto;

third waveform signal producing means arranged to be sychronouesly controlled by said second waveform producing means for repeatedly producing a third waveform signal starting from a predetermined phase at each cycle of the second waveform signal at a shorter cycle than that of the second waveform signal;

means for multiplying the second and third waveform signals to produce a fourth waveform signal as a musical tone signal; and modulation means for applying the fourth waveform signal as a modulation signal to said first waveform signal producing means for modulation of the first waveform signal.

5. A musical tone signal synthesizer comprising:

a first calculation unit including first waveform signal producing means for producing a first waveform signal of a frequency defined by first frequency information applied thereto and first modulation means for modulating the first waveform signal by a first modulation signal applied thereto;

a second calculation unit including second waveform signal producing means for repeatedly producing a second waveform signal indicative of a windowing function at a cycle corresponding with a frequency defined by second frequency information applied thereto, third waveform producing means to be synchronously controlled by said second waveform signal producing means for repeatedly producing a third waveform signal starting from a predetermined phase at each cycle of the second waveform signal at a shorter cycle than that of the second waveform signal, means for multiplying the second and third waveform signals to produce a fourth waveform signal and second modulation means for modulating the second and third waveform signals by a second modulation signal applied thereto;

selective connection means for selectively connecting an output of said first calculation unit to a modulation input of said second modulation means in said second calculation unit and for selectively connecting all output of said second calculation unit to a modulation input of said first modulation means in said first calculation unit;

wherein the output signal of said first or second calculation unit is output as a musical tone signal.

* * * * *

UNITED STATES PATENT AND TRADEMARK OFFICE

CERTIFICATE OF CORRECTION

PATENT NO. : 5,610,354

DATED : March 11, 1997

INVENTOR(S) : Masahiro Koyama, et al

It is certified that error appears in the above-identified patent and that said Letters Patent is hereby corrected as shown below:

On the title page, item [75] Inventors: Masahiro Koyama; Tetsuo Nishimoto, both of Hamamatsu, Japan Signed and Sealed this Ninth Day of December, 1997

*Attest:*

*Attesting Officer*

BRUCE LEHMAN

*Commissioner of Patents and Trademarks*